US010316491B2

(12) United States Patent
Gentle et al.

(10) Patent No.: US 10,316,491 B2
(45) Date of Patent: Jun. 11, 2019

(54) MACHINE CONTROL SYSTEM HAVING MULTI-BLADE POSITION COORDINATION

(71) Applicant: Caterpillar Inc., Peoria, IL (US)

(72) Inventors: Michael Charles Gentle, Maroa, IL (US); Daniel Patrick Gillen, Macon, IL (US)

(73) Assignee: Caterpillar Inc., Deerfield, IL (US)

( * ) Notice: Subject to any disclaimer, the term of this patent is extended or adjusted under 35 U.S.C. 154(b) by 228 days.

(21) Appl. No.: 15/230,850

(22) Filed: Aug. 8, 2016

(65) Prior Publication Data

US 2018/0038066 A1 Feb. 8, 2018

(51) Int. Cl.

| | |
|---|---|
| ***E02F 3/84*** | (2006.01) |
| ***E02F 3/76*** | (2006.01) |
| ***E02F 3/96*** | (2006.01) |
| ***E02F 9/26*** | (2006.01) |
| *E02F 9/20* | (2006.01) |

(52) U.S. Cl.

CPC ..... *E02F 3/844* (2013.01); *E02F 3/7604* (2013.01); *E02F 3/7609* (2013.01); *E02F 3/7636* (2013.01); *E02F 3/961* (2013.01); *E02F 9/262* (2013.01); *E02F 9/2041* (2013.01)

(58) Field of Classification Search

CPC ..... E02F 3/7604; E02F 3/7609; E02F 3/7613; E02F 3/7618; E02F 3/7636; E02F 3/844; E02F 3/961

See application file for complete search history.

(56) References Cited

U.S. PATENT DOCUMENTS 2,686,982 A * 8/1954 Leliter ..... E02F 3/7604 172/784
3,085,648 A * 4/1963 Di Benedetto ..... B66F 11/044 182/2.9
3,450,213 A * 6/1969 Hanser ..... E02F 3/7604 172/781

(Continued)

FOREIGN PATENT DOCUMENTS

RU 2059756 C1 * 5/1996

OTHER PUBLICATIONS

EPO machine translation of RU 2059756 C1 (original RU document published May 10, 1996) (Year: 1996).*

(Continued)

*Primary Examiner* — Behrang Badii
*Assistant Examiner* — David A Testardi
(74) *Attorney, Agent, or Firm* — Finnegan, Henderson, Farabow, Garrett & Dunner, LLP

(57) ABSTRACT

A control system is disclosed for use with a machine. The control system may have a first blade mountable to the machine and configured to engage a ground surface below the machine, and at least a first actuator configured to move the first blade. The control system may also have a second blade mountable to the machine and configured to engage the ground surface below the machine, and at least a second actuator configured to move the second blade. The control system may additionally have a controller in communication with the at least a second actuator. The controller may be configured to determine a first position of the first blade, and to automatically cause the at least a second actuator to move the second blade to a second position based on the first position of the first blade.

20 Claims, 2 Drawing Sheets

(56) References Cited

U.S. PATENT DOCUMENTS

| | | | | |
|---|---|---|---|---|
| 4,213,507 | A * | 7/1980 | Horrer | E02F 3/7604 172/784 |
| 4,354,321 | A | 10/1982 | Weatherholt | |
| 4,643,261 | A | 2/1987 | Long | |
| 5,076,370 | A * | 12/1991 | Stubben | A01B 15/02 172/684.5 |
| 5,631,658 | A * | 5/1997 | Gudat | A01B 79/005 342/357.31 |
| 5,685,377 | A | 11/1997 | Arstein et al. | |
| 5,951,613 | A | 9/1999 | Sahm et al. | |
| 5,964,298 | A * | 10/1999 | Greenspun | E02F 3/842 172/4.5 |
| 6,028,524 | A | 2/2000 | Hartman et al. | |
| 6,047,227 | A * | 4/2000 | Henderson | E02F 9/2045 172/4.5 |
| 6,206,106 | B1 * | 3/2001 | Heckendorf | A01B 31/00 172/799.5 |
| 6,269,885 | B1 | 8/2001 | Barber et al. | |
| 6,278,955 | B1 | 8/2001 | Hartman et al. | |
| 6,655,465 | B2 | 12/2003 | Carlson et al. | |
| 7,676,967 | B2 | 3/2010 | Gharsalli et al. | |
| 7,841,423 | B2 | 11/2010 | Damm et al. | |
| 8,103,417 | B2 | 1/2012 | Gharsalli et al. | |
| 8,141,650 | B2 | 3/2012 | Breiner et al. | |
| 9,809,956 | B1 * | 11/2017 | Sherlock | E02F 9/2054 |
| 2002/0162669 | A1 * | 11/2002 | L'abbe | E01H 4/02 172/787 |
| 2006/0151187 | A1 * | 7/2006 | Damm | E02F 3/7604 172/810 |
| 2008/0127530 | A1 * | 6/2008 | Kelly | E02F 3/847 37/403 |
| 2011/0108294 | A1 * | 5/2011 | Thomson | E02F 3/764 172/1 |
| 2013/0255977 | A1 * | 10/2013 | Braunstein | E02F 3/764 172/4.5 |
| 2014/0019013 | A1 * | 1/2014 | Liu | E02F 3/844 701/50 |
| 2016/0222626 | A1 * | 8/2016 | May | E02F 3/80 |
| 2017/0101762 | A1 * | 4/2017 | Chaston | E02F 3/844 |

OTHER PUBLICATIONS

Kennametal brochure, "Grader blades for earth moving and snow removal", Copyright 2015 (Google date Feb. 18, 2015), 40 pages (Year: 2015).*

Wikipedia article, "Grader", Old revision dated Jul. 21, 2016, 3 pages (Year: 2016).*

* cited by examiner

MACHINE CONTROL SYSTEM HAVING MULTI-BLADE POSITION COORDINATION

TECHNICAL FIELD

The present disclosure relates generally to a control system and, more particularly to a machine control system having multi-blade position coordination.

BACKGROUND

An earth working machine can be equipped with a blade that is selectively lowered into a ground surface to scrape away material and thereby shape a surface contour. For example, a motor grader can include a moldboard located at an underbelly position, between a front wheel and a rear wheel. Any number of hydraulic actuators can be connected to the moldboard and selectively pressurized to raise, lower, rotate, twist, and/or tilt the moldboard to thereby affect a location, angle, and depth of the resulting cut. In some embodiments, the movements of the moldboard may be automated, for example based on an actual ground contour, a planned ground contour, and/or a measured blade position. In another example, a dozer can include a dozing blade located at a leading end, forward of a front wheel. Like the moldboard, any number of hydraulic actuators can be connected to the dozing blade and selectively pressurized to raise, lower, rotate, twist, and/or tilt the dozing blade.

Some earth working machines can be simultaneously equipped with multiple different blades. U.S. Pat. No. 7,841,423 that issued to Damm et al. on Nov. 30, 2010 ("the '423 patent") discloses such a machine. In particular, the '423 patent discloses a motor grader having a mid-located moldboard and a forward-located dozing blade. With this configuration, a motor grader operator could manually complete a rough pass using the dozing blade, followed by an automated final pass using the moldboard.

Although the machine of the '423 patent may have increased functionality provided by two different blades, it may also be problematic. In particular, it may be difficult for an operator to manually control the dozing blade, as visibility of an area in front of the dozing blade from inside of a typical motor grader cabin may be poor.

The disclosed machine system is directed to overcoming one or more of the problems set forth above and/or other problems of the prior art.

SUMMARY

In one aspect, the present disclosure is directed to a control system for a machine. The control system may include first blade mountable to the machine and configured to engage a ground surface below the machine, and at least a first actuator configured to move the first blade. The control system may also include a second blade mountable to the machine and configured to engage the ground surface below the machine, and at least a second actuator configured to move the second blade. The control system may additionally include a controller in communication with the at least a second actuator. The controller may be configured to determine a first position of the first blade, and to automatically cause the at least a second actuator to move the second blade to a second position based on the first position of the first blade.

In another aspect, the present disclosure is directed to a method for controlling a machine. The method may include determining a ground surface position, determining a planned contour position, and determining a first position of a first ground-engaging blade of the machine. The method may also include determining a mode of operation of the machine, and automatically causing a second ground-engaging blade of the machine to move to a second position based on one of the ground surface position, the planned contour position, and the first position of the first ground-engaging blade of the machine.

In another aspect, the present disclosure is directed to a machine. The machine may include a front frame having a steerable front wheel, a rear frame having a driven rear wheel and being pivotally connected to the front frame, a moldboard blade suspended from the front frame between the steerable front wheel and the driven rear wheel, and a first hydraulic actuator configured to move the moldboard blade relative to the front frame. The machine may also include a dozing blade mounted to the front frame forward of the steerable front wheel, and a second hydraulic actuator configured to move the dozing blade relative to the front frame. The machine may further include a first sensor configured to generate a first signal indicative of a position of the moldboard blade, a second sensor configured to generate a second signal indicative of a position of the dozing blade, and a controller in communication with the first hydraulic actuator, the second hydraulic actuator, the first sensor, and the second sensor. The controller may be configured to automatically cause the first hydraulic actuator to move the moldboard blade based on the first signal, and to automatically cause the second hydraulic actuator to move the dozing blade based on the first and second signals.

DETAILED DESCRIPTION

Figure 1:
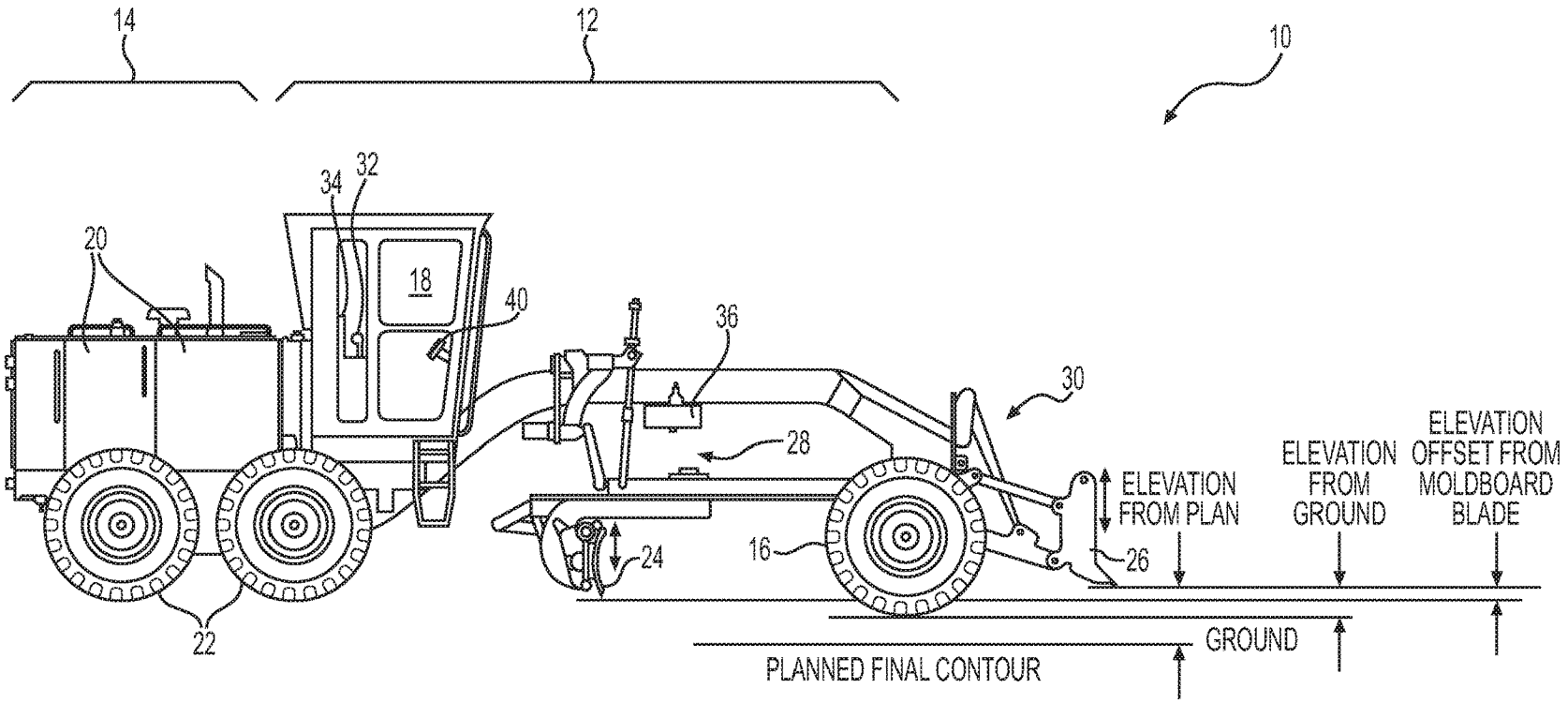
FIG. 1 is an side-view perspective illustration of an exemplary disclosed machine.

FIG. 1 illustrates an exemplary disclosed mobile machine 10. In the depicted example, machine 10 is a motor grader. As a motor grader, machine 10 may include a steerable front frame 12, and a driven rear frame 14 that is pivotally connected to front frame 12. Front frame 12 may include a pair of front wheels 16 (or other traction devices), and support a cabin 18. Rear frame 14 may include compartments 20 for housing a power source (e.g., an engine) and associated cooling components, the power source being operatively coupled to rear wheels 22 (or other traction devices) for primary propulsion of machine 10. Rear wheels 22 may be arranged in tandems at opposing sides of rear frame 14. Steering of machine 10 may be a function of both front wheel steering and articulation of front frame 12 relative to rear frame 14.

Machine 10 may also include ground-engaging work tools such as, for example, a moldboard blade 24 and a dozing blade 26. Moldboard blade 24 and dozing blade 26 may both be operatively connected to and supported by front frame 12. In the disclosed embodiment, moldboard blade 24 hangs from a general midpoint of front frame 12, at a location between front and rear wheels 16, 22. In this same embodiment, dozing blade 26 is supported at a leading end of front frame 12 (e.g., at a location forward of front wheels 16, relative to a normal travel direction). In some embodiments, rear frame 14 may also support one or more ground-engaging work tools (e.g., a ripper), if desired. It is contemplated that moldboard blade 24, dozing blade 26, and/or the ripper could alternatively be connected to and supported by another portion of machine 10, such as by another portion of front frame 12 and/or rear frame 14.

Both of moldboard blade 24 and dozing blade 26 may be supported via separate hydraulic arrangements. In particular, a first hydraulic arrangement 28 having any number of different actuators (e.g., cylinders and/or motors) may be configured to shift moldboard blade 24 vertically toward and away from front frame 12, to shift moldboard blade 24 side-to-side, and/or to rotate moldboard blade 24 about horizontal and/or vertical axes. A second hydraulic arrangement 30 having any number of different actuators may be configured to shift dozing blade 26 vertically toward and away from front frame 12. It is contemplated that moldboard blade 24 and dozing blade 26 may move in additional and/or different ways than described above, if desired.

Cabin 18 may house components configured to receive input from a machine operator indicative of a desired machine and/or work tool movement. Specifically, cabin 18 may house one or more input devices 32 embodied, for example, as single- or multi-axis joysticks located in proximity to an operator seat 34. Input devices 32 may be proportional-type controllers configured to position or orient machine 10 and the work tools by producing position signals indicative of desired speeds and/or forces in a particular direction. It is contemplated that different input devices 32 may alternatively or additionally be included within cabin 18 such as, for example, wheels, knobs, push-pull devices, switches, pedals, and other operator input devices known in the art.

During operation of machine 10, the operator may manipulate input devices 32 from inside cabin 18 to perform tasks that require high precision. For example, the operator may need to position moldboard blade 24 and/or dozing blade 26 at precise locations and/or in precise orientations in order to create a planned contour at a worksite without causing collision with another portion of machine 10 and/or with obstacles at the worksite. Similarly, the operator may need to move machine 10, itself, along a precise trajectory. And in order for the operator to make these movements accurately and efficiently, and without damaging machine 10 or its surroundings, the operator may sometimes rely on position-feedback from a locating device 36.

As each machine 10 travels about the worksite, a Global Navigation Satellite System (GNSS), a local laser tracking system, or another type of positioning device or system may communicate with locating device 36 to monitor the movements of machine 10 and/or the ground-engaging work tools (e.g., of moldboard blade 24 and/or dozing blade 26) and to generate corresponding position signals. The position signals may be directed to an onboard controller 38 (shown only in FIG. 2), for comparison with an electronic contour plan of the worksite and for further processing. As shown in FIG. 1, the further processing may include, among other things, determining a current ground location under machine 10; a planned final contour of the worksite; a current elevation of moldboard blade 24 and/or dozing blade 26 relative to the ground location; a current elevation of moldboard blade 24 and/or dozing blade 26 relative to the planned final contour; and/or a current elevation of dozing blade 26 relative to moldboard blade 24.

Controller 38 may embody a single microprocessor or multiple microprocessors that include a means for controlling an operation of machine 10. Numerous commercially available microprocessors can be configured to perform the functions of controller 38. Controller 38 can include a memory, a secondary storage device, a processor, and any other components for running an application. Various other circuits may be associated with controller 38 such as power supply circuitry, signal conditioning circuitry, solenoid driver circuitry, and other types of circuitry.

The position-feedback described above may be provided visually to the operator of machine 10. For example, a display 40 may be provided within cabin 18 in proximity to seat 34. Display 40 may include one or more monitors (e.g., a liquid crystal display (LCD), a cathode ray tube (CRT), a personal digital assistant (PDA), a plasma display, a touch-screen, a portable hand-held device, or any such display device known in the art) configured to actively and responsively show the different elevations described above to the operator of machine 10. Display 40 may be connected to controller 38, and controller 38 may execute instructions to render graphics and images on display 40 that are associated with operation of machine 10.

Figure 2:
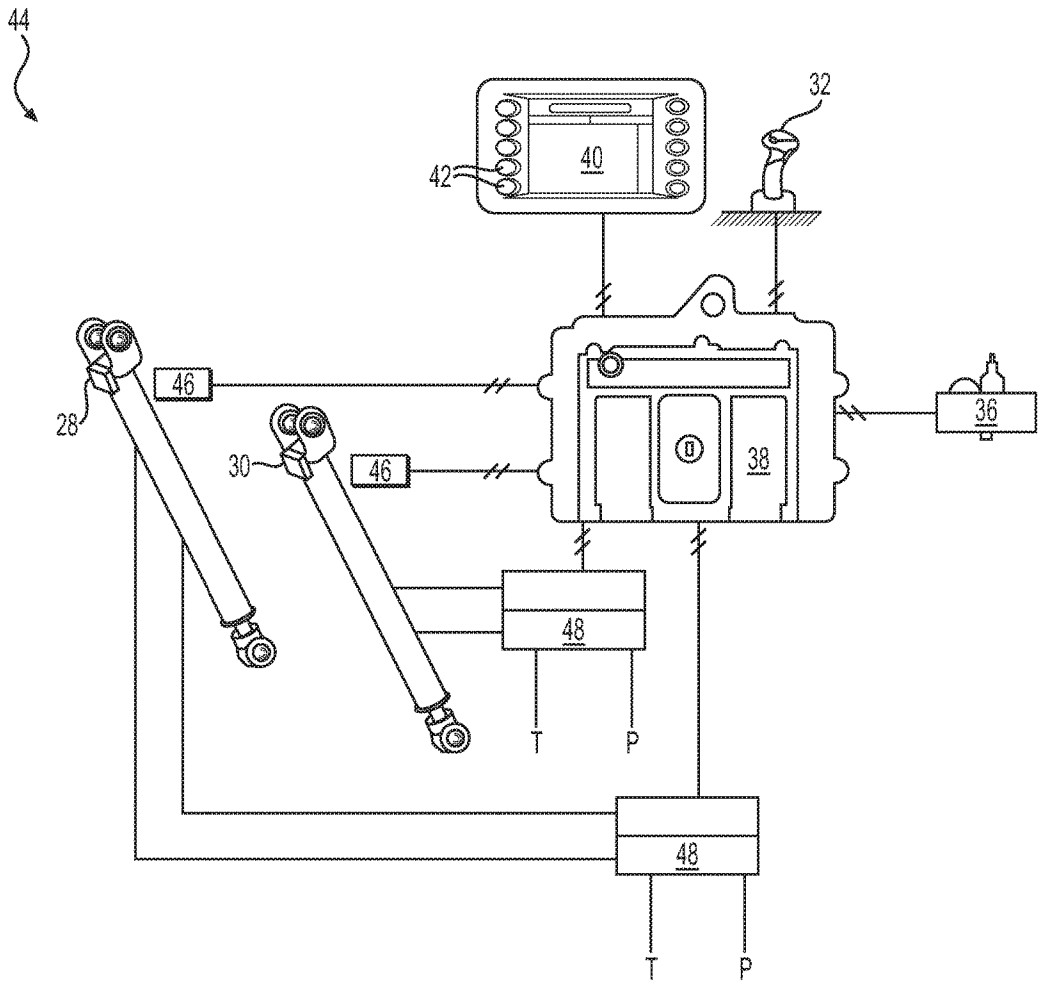
FIG. 2 is a diagrammatic illustration of an exemplary disclosed system that may be used in conjunction with the machine of FIG. 1.

In some embodiments, display 40 may also be configured to receive input indicative of different modes of machine operation. For example, as shown in FIG. 2, display 40 may include one or more buttons (real or virtual) 42, switches, knobs, dials, etc. that, when manipulated by the operator, generate corresponding signals directed to controller 38. These signals may be used by controller 38 to implement, for example, a manual mode of operation, a semi-autonomous mode of operation, and/or a completely autonomous mode of operation. During the manual mode of operation, the operator of machine 10 may manipulate input devices 32 to directly control movement of moldboard blade 24 and dozing blade 26. During the semi-autonomous mode of operation, the operator may move input devices 32 to directly control movement of only one work tool (e.g., only moldboard blade 24). And in response to the movement of the manually-controlled work tool and/or based on one or more of the relative locations described above, controller 38 may responsively and autonomously regulate movement of the remaining work tool (e.g., dozing blade 26). During the autonomous mode of operation, controller 38 may regulate movement of all work tools (e.g., moldboard blade 24 and dozing blade 26).

As shown in FIG. 2, hydraulic arrangement 28, hydraulic arrangement 30, input device(s) 32, controller 38, and display 40 may together form a control system 44. In some embodiments, control system 44 may additionally include one or more sensors 46 and/or one or more valves 48 associated with hydraulic arrangements 28 and 30. As will be explained below, based on input received via input device(s) 32, based on the electronic plan of the work site, based on the relative locations described above, and/or based on input from locating device 36, display 40, and/or sensors 46, controller 38 may be configured to selectively energize valves 48 to cause corresponding movements of hydraulic arrangements 28, 30.

Sensors 46 may be position sensors that are configured to generate signals indicative of the positions of the related work tools (e.g., of the cutting edges of moldboard blade 24 and dozing blade 26). In one embodiment, sensors 46 are associated with one or more actuators of hydraulic arrangements 28 and 30, and configured to detect extensions of the actuators. Based on the detected extensions and known kinematics of machine 10, controller 38 may be configured to determine the positions of moldboard blade 24 and/or dozing blade 26. In another embodiment, sensors 46 are joint-angle sensors, configured to detect pivoting of one or more links within hydraulic arrangements 28 and 30. Based on the detected pivoting and known kinematics of machine 10, controller 38 may be configured to determine the positions of moldboard blade 24 and/or dozing blade 26. In yet another embodiment, sensors 46 may be configured to directly measure a position of moldboard blade 24 and/or dozing blade 26 (e.g., relative to front frame 12). In any of the disclosed embodiments, the signals generated by sensors 46 may represent offset positions, relative to a position of machine 10 detected by locating device 36. Other types of sensors 46 may also or alternatively be utilized to determine the cutting edge location of each blade, if desired. It is also contemplated that sensors 46 may be omitted, if desired, and controller 38 may rely solely on signals generated by locating device 36 to determine the cutting edge positions of moldboard and dozing blades 24, 26.

Valves 48 may be configured to selective direct pressurized fluid into and/or out of different chambers within the actuators of hydraulic arrangements 28 and/or 30 in response to manual input received via input device 32 and/or in response to commands generated by controller 38. For example, valves 48 may be movable between positions at which a pump supply passage is connected with a particular chamber, or a tank drain passage is connected with the particular pressure. As is known in the art, these connections may result in an imbalance of pressure inside the associated actuator(s) that functions to either extend or retract the actuator(s).

INDUSTRIAL APPLICABILITY

The disclosed control system may be applicable to any mobile machine where cooperative control of multiple work tools is desired. The disclosed control system finds particular applicability in construction and earthmoving machines, for example in motor graders that have multiple ground-engaging blades in fore/aft staggered positions. The disclosed control system provides manual, semi-autonomous, and fully autonomous modes of operation, wherein the different blades are cooperatively controlled based on operator input, a contour plan, a detected ground surface location, and/or detected relative positions of the blades. The disclosed system will now be described in more detail below.

During operation of machine 10, the operator may be tasked with transforming a surface at a worksite to match a planned contour. In some instances, this transformation may require removal of a certain depth of material from a particular area at the worksite. Conventionally the material would be removed in one or more rough passes and a subsequent final pass. The conventional process, however, can be inefficient and slow.

In the disclosed embodiment, the material normally removed during the rough passes may be removed by dozing blade 26, while the material normally removed during the subsequent final pass may be removed by moldboard blade 24 during the same pass. This removal of material may be accomplished via any of the available modes of operation described above.

For example, in the manual mode of operation, the operator may manipulate a first input device 32 to generate commands directed to hydraulic arrangement 30 (e.g., to valve 48), causing the associated actuator(s) to push dozing blade 26 into the ground surface to a first depth. At this same time, the operator may manipulate a second input device 32 to generate commands directed to hydraulic arrangement 28 (e.g., to valve 48) causing the associated actuator(s) to push moldboard blade 24 into the ground surface behind dozing blade 26 to a second depth. The second depth, in this embodiment, may generally align with the final planned contour (referring to FIG. 1), while the first depth may be some ratio of the second depth. The ratio used to set the first depth may be at least partially dependent on a type and compaction level of the material being moved. as well as configurations of machine 10, moldboard blade 24, and/or dozing blade 26. The manual mode of operation may be selected, for example, based on input received via buttons 42 on display 40. Feedback regarding the ground surface location, the final planned contour, and the cutting edge locations of moldboard blade 24 and dozing blade 26 may be determined by controller 38 based on signals from locating device 36 and/or sensors 46, and shown on display 40.

In the semi-autonomous mode of operation, the operator may manipulate only the second input device 32 to generate commands causing the associated actuator(s) to push moldboard blade 24 into the ground surface behind dozing blade 26 to the second depth. And based on a detected position of moldboard blade 24 (e.g., the elevation of dozing blade 26 from moldboard blade 24), based on a known position of the final planned contour (e.g., the elevation of dozing blade 26 from the final planned contour), and/or based on the detected position of the ground surface (e.g., the elevation of dozing blade 26 from the ground surface), controller 38 may automatically generate commands directed to hydraulic arrangement 30 (e.g., to valve 48) causing the associated actuator(s) to push dozing blade 26 into the ground surface to the first depth. In this mode of operation, the operator may only need to manually control a single work tool (e.g., moldboard blade 24, which can be easily seen from inside of cabin 18), which greatly eases the burden on the operator. It is contemplated that the operator may alternatively directly control the depth of only dozing blade 26, if desired, thereby allowing controller 38 to autonomously regulate the depth of moldboard blade 24 in a manner similar to that described above. The semi-autonomous mode of operation may be selected, for example, based on input received via buttons 42 on display 40. Like operation in the manual mode, controller 38 may also provide feedback during the semi-autonomous mode regarding the ground surface location, the final planned contour, and the cutting edge locations of moldboard blade 24 and dozing blade 26 via display 40.

In the fully-autonomous mode of operation, the operator may not need to manipulate any input device 32. In particular, controller 38 may autonomously generate commands causing the associated actuator(s) to push moldboard and dozing blades 24, 26 into the ground surface to the second and first depths, respectively. For example, based on the known position of the final planned contour and/or based on the detected position of the ground surface, controller 38 may determine the ratio of material that should be removed by each of moldboard and dozing blades 24, 26, and generate corresponding depth commands. The fully-autonomous mode of operation may be selected, for example, based on input received via buttons 42 on display 40. Like operation in the manual and semi-autonomous modes, controller 38 may also provide feedback during the fully-autonomous mode regarding the ground surface location, the final planned contour, and the cutting edge locations of moldboard blade 24 and dozing blade 26 via display 40.

The disclosed system may simplify motor grader control and provide improved efficiency and contour shaping. Specifically, the disclosed control system may autonomously control the disclosed front-mounted dozing blade, which is normally obstructed from operator view. The automated control of the disclosed front-mounted dozing blade may be coordinated with manual and/or automated control of the disclosed mid-mounted moldboard blade in order to increase an amount of material removed during each pass of the motor grader and to improve accuracy in the resulting contour. The automated control may also reduce the burden on the operator.

It will be apparent to those skilled in the art that various modifications and variations may be made to the disclosed control system without departing from the scope of the disclosure. Other embodiments of the disclosed control system will be apparent to those skilled in the art from consideration of the specification and practice of the control system disclosed herein. It is intended that the specification and examples be considered as exemplary only, with a true scope of the disclosure being indicated by the following claims and their equivalents.

What is claimed is:

1. A control system for a machine, comprising:

a first blade mountable to the machine and configured to engage a ground surface below the machine;

at least a first actuator configured to move the first blade;

a second blade mountable to the machine and configured to engage the ground surface below the machine;

at least a second actuator configured to move the second blade; and a controller in communication with an input device configured to be manipulated by an operator to select at least one of a semi-autonomous or completely autonomous mode of operation of the machine, the at least a first actuator, and the at least a second actuator, the controller being configured to:

determine a second position of the second blade; and upon selection by the operator of the semi-autonomous mode of operation, responsively and autonomously cause the at least a first actuator to move the first blade to a first position based on the second position of the second blade, wherein the second position is a second depth to which the second blade is pushed into the ground surface, and the first position is a first depth to which the first blade is pushed into the ground surface, and the first depth is less than the second depth and the first depth is determined based on factors that include a detected elevation of the first blade from the second blade, an elevation of the first blade from a final planned contour of the ground surface, and an elevation of the first blade from the ground surface.

2. The control system of claim 1, wherein the second position is determined based on a command to move the at least a second actuator.

3. The control system of claim 2, wherein the controller is further configured to automatically generate the command to move the at least a second actuator.

4. The control system of claim 3, wherein the controller is configured to:

automatically cause the at least a first actuator to move the first blade to perform a rough cut during an excavation pass; and automatically cause the at least a second actuator to move the second blade to perform a final cut during the excavation pass.

5. The control system of claim 2, wherein the command to move the at least a second actuator is manually generated by an operator of the machine.

6. The control system of claim 1, further including a sensor configured to generate a signal indicative of the second position, wherein the controller is configured to determine the second position based on the signal.

7. The control system of claim 1, wherein:

the first blade is a dozing blade; and the second blade is a moldboard blade.

8. The control system of claim 7, wherein:

the at least a first actuator is configured to lift the dozing blade; and the at least a second actuator is configured to lift the moldboard blade.

9. The control system of claim 8, wherein the at least a second actuator is further configured to pivot the moldboard blade about a first vertical axis that is normal to the ground surface.

10. The control system of claim 1, wherein the controller is configured to automatically cause the at least a first actuator to move the first blade to the first position based on the second position of the second blade during operation in a first mode, and based on an electronic contour plan stored in the controller and indicative of a desired contour of the ground surface during operation in a second mode.

11. The control system of claim 10, wherein the controller is further configured to automatically cause the at least a first actuator to move the first blade to the first position based on a distance of an edge of the first blade from the ground surface located below the first blade during operation in a third mode.

12. A method of controlling a machine, comprising:

determining a ground surface position;

determining a planned contour position;

determining a second position of a second ground-engaging blade of the machine;

determining a mode of operation of the machine; and responsive to the mode of operation of the machine, automatically causing a first ground-engaging blade of the machine to move to a first position, wherein the second position is a second depth to which the second blade is pushed into the ground surface, and the first position is a first depth to which the first blade is pushed into the ground surface, and the first depth is less than the second depth and the first depth is determined based on factors that include a detected elevation of the first blade from the second blade, an elevation of the first blade from a final planned contour of the ground surface, and an elevation of the first blade from the ground surface.

13. The method of claim 12, wherein determining the second position includes determining the second position based on a command to move the at least a second actuator.

14. The method of claim 13, wherein the command is automatically generated.

15. The method of claim 13, wherein the command is manually generated.

16. The method of claim 12, further including:

automatically causing the first ground-engaging blade to move to perform a rough cut during an excavation pass; and automatically causing the second ground-engaging blade to move to perform a final cut during the excavation pass.

17. The method of claim 12, wherein determining the second position includes sensing the second position.

18. The method of claim 12, wherein:

automatically causing the first ground-engaging blade of the machine to move to the first position includes automatically causing the first ground-engaging blade of the machine to move to the first position based on a distance from the second position during operation in a first mode; and the method further includes automatically causing the first ground-engaging blade of the machine to move to the first position based on a distance from an edge of the first ground-engaging blade to the planned contour position during operation in a second mode.

19. The method of claim 18, further including automatically causing the first ground-engaging blade to move to the first position based on a distance from an edge of the first ground-engaging blade to the ground surface position during a third mode.

20. A machine, comprising:

a front frame having a steerable front wheel;

a rear frame having a driven rear wheel and being pivotally connected to the front frame;

a moldboard blade suspended from the front frame, between the steerable front wheel and the driven rear wheel;

a second hydraulic actuator configured to move the moldboard blade relative to the front frame;

a dozing blade mounted to the front frame forward of the steerable front wheel;

a first hydraulic actuator configured to move the dozing blade relative to the front frame;

a second sensor configured to generate a second signal indicative of a position of the moldboard blade;

a first sensor configured to generate a first signal indicative of a position of the dozing blade; and a controller in communication with an input device configured to be manipulated by an operator to select at least a completely autonomous mode of operation of the machine, the first hydraulic actuator, the second hydraulic actuator, the first sensor, and the second sensor, the controller being configured to:

automatically cause the second hydraulic actuator to move the moldboard blade based on the second signal; and automatically cause the first hydraulic actuator to move the dozing blade based on the first and second signals, wherein the position of the dozing blade is a first depth to which the dozing blade is pushed into a ground surface, and the position of the moldboard blade is a second depth to which the moldboard blade is pushed into the ground surface, and the first depth is less than the second depth and the first depth is determined based on factors that include a desired ratio of material that should be removed by each of the moldboard blade and the dozing blade, a known position of a final planned contour of the ground surface, and a detected position of the ground surface.

* * * * *